US006513730B1

(12) United States Patent
Okojie

(10) Patent No.: US 6,513,730 B1
(45) Date of Patent: Feb. 4, 2003

(54) MEMS-BASED SPINNING NOZZLE

(75) Inventor: Robert S. Okojie, Strongsville, OH (US)

(73) Assignee: The United States of America as represented by the National Aeronautics and Space Administration, Washington, DC (US)

( * ) Notice: Subject to any disclaimer, the term of this patent is extended or adjusted under 35 U.S.C. 154(b) by 59 days.

(21) Appl. No.: 09/816,722

(22) Filed: Mar. 21, 2001

(51) Int. Cl.[7] ..... B05B 3/06

(52) U.S. Cl. ..... 239/251; 239/261; 239/381; 239/419; 239/494; 239/496

(58) Field of Search ..... 239/251, 261, 239/264, 380, 381, 382, 383, 491, 492, 494, 496, 497, 463, 468, 419, 290, 600

(56) References Cited

U.S. PATENT DOCUMENTS 3,125,297 A * 3/1964 Copeland et al. ..... 239/261
3,771,728 A * 11/1973 Polnauer ..... 239/492
3,932,988 A 1/1976 Beautrere
3,983,694 A 10/1976 Bracken, Jr.
4,257,236 A 3/1981 Morishita
4,260,110 A * 4/1981 Werding ..... 239/492
4,502,635 A 3/1985 Klomp
5,570,841 A * 11/1996 Pace et al. ..... 239/496
5,934,569 A 8/1999 Soule
5,947,389 A 9/1999 Hasegawa
5,954,274 A 9/1999 Sumida
5,975,433 A 11/1999 Hasegawa
6,029,913 A 2/2000 Strola
6,042,028 A 3/2000 Xu
6,070,811 A 6/2000 Takeda
6,089,473 A 7/2000 Keim
6,105,883 A 8/2000 Takeda
6,145,761 A * 11/2000 Muller et al. ..... 239/494

* cited by examiner

*Primary Examiner*—Steven J. Ganey
(74) *Attorney, Agent, or Firm*—Kent N. Stone

(57) ABSTRACT

A nozzle body and assembly for delivering atomized fuel to a combustion chamber. The nozzle body is rotatably mounted onto a substrate. One or more curvilinear fuel delivery channels are in flow communication with an internal fuel distribution cavity formed in the nozzle body. Passage of pressurized fuel through the nozzle body causes the nozzle body to rotate. Components of the nozzle assembly are formed of silicon carbide having surfaces etched by deep reactive ion etching utilizing MEMS technology. A fuel premix chamber is carried on the substrate in flow communication with a supply passage in the nozzle body.

6 Claims, 4 Drawing Sheets

MEMS-BASED SPINNING NOZZLE

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

1. Field of the Invention

This invention pertains to the art of fuel injector nozzle assemblies and more particularly to a rotating micro nozzle assembly having an integrated premixing chamber.

2. Description of the Related Art

In a combustion apparatus such as an engine, fuel distribution in the combustion chamber is an important factor relating to optimization of the combustion process.

Fuel injection nozzles used in present day combustion engines suffer from limited spray angle. For instance, fuel spray patterns are typically constrained to cone angles of less than 90 degrees, leading to combustion instabilities caused by non-uniform temperature distribution within the engine. This non-uniformity causes inefficient fuel combustion leading to emission of undesired combustion products. As a result, many nozzles are used to cover a wide area in an attempt to provide efficient fuel burning.

Some existing fluid delivery systems attempt to provide more optimal fuel distribution through the generation of smaller size droplets that provide a larger surface area for improved combustion. Nozzles with multiple holes and/or swirlers or air/fuel pre-mix capabilities are known in the art.

However, there is still a need in the art for improvement in uniform temperature distribution in the combustion chamber as well as reduced system complexity.

Microelectromechanical systems (MEMS) are being used in a wide variety of applications. The present invention is directed to a MEMS-based spinning nozzle that addresses the needs in the art of fuel injectors.

SUMMARY OF THE INVENTION

The present invention provides a spinning micro nozzle mechanism with an integrated premixing chamber.

It is a primary object of the present invention to provide a micro nozzle assembly having a rotatable nozzle for providing atomized fuel to a combustion chamber.

It is a further object of the invention to provide a nozzle body having components formed by an etching process in silicon carbide.

It is a further object of the invention to provide a method of assembling a nozzle assembly having an integrated premix chamber and a rotatable nozzle member.

In the present invention, there is provided a nozzle assembly adapted to deliver fuel from an associated supply source to an associated combustion chamber. The nozzle assembly comprises a rotatable nozzle body having a first flange surface and including a supply passage aligned on a main axis thereof, the rotatable nozzle body being adapted for rotation about the main axis and defining an internal fuel distribution cavity in flow communication with the supply passage. The rotatable member further defines a curvilinear fuel delivery channel in flow communication with the internal fuel distribution cavity disposed in a plane generally perpendicular to the main axis. The curvilinear fuel delivery channel has an outlet opening through an exterior surface of the nozzle body. The nozzle assembly further includes substrate means having a bore aligned on the main axis for rotatably supporting the nozzle body. The substrate means includes a first seating surface for seating the flange surface.

According to one aspect of the invention, the nozzle assembly further comprises means carried on the substrate for premixing fuel from the associated supply source, wherein the premixing means are operative to deliver the fuel to the supply passage.

According to another aspect of the invention the nozzle assembly further includes means carried on the substrate for providing pressurized air to the associated combustion chamber, wherein the air providing means are operative to direct a stream of air past the outlet.

According to another aspect of the invention, the nozzle body comprises a spacer member having a hollow cylindrical body having first and second ends, wherein the supply passage is defined by an internal surface thereof; an anchor member fixedly secured to the first end of the spacer member, wherein the anchor member encompasses the first flange surface; and, a base member fixedly secured to the second end of the spacer member, wherein the base member encompasses the internal fuel distribution cavity and the curvilinear fuel delivery channel.

According to another aspect of the invention, the base member comprises a first body portion affixed to the spacer member; and, a second body portion affixed to said first body portion; wherein said first body portion and said second body portion cooperate to form said internal fuel distribution cavity and said curvilinear fuel delivery channel.

According to another aspect of the invention, the first body portion comprises a planar surface having an open cavity formed therein and an open curvilinear channel communicating with the cavity and extending through an exterior surface of the first body portion; and the second body portion has a planar surface abutting the planar surface of the first body portion to cap the open cavity and the open curvilinear channel.

According to another aspect of the invention, there is provided a method for forming a nozzle assembly comprising the steps of providing a substrate having first and second surfaces and a bore extending therebetween; providing a spacer member having a hollow cylindrical body, first and second ends, and an internal surface defining a supply passage aligned on an axis thereof; providing an anchor member having a flange surface adapted to seat on the first surface of the substrate; providing a base member defining an internal fuel distribution cavity and at least one curvilinear fuel delivery channel in flow communication with the internal distribution cavity, the curvilinear fuel delivery channel extending through an exterior surface of the base member to define an outlet; inserting the spacer member through the substrate bore; affixing the anchor member to the first end of the spacer member; seating the flange surface on the first surface of the substrate, and affixing the base member to the second end of the spacer member.

According to another aspect of the invention, the step of providing a base member further includes the steps of providing a first body portion comprising silicon carbide having a planar surface; etching first body portion to form an open cavity in the planar surface and an open curvilinear passage communicating with the cavity, wherein the curvilinear passage extends through an exterior surface of the first body portion; and providing a second body portion having a planar surface; and bonding said planar surface of said second body portion to said planar surface of said first body portion to form said base member.

One advantage of the present invention is the improved spray angle achieved by the rotating nozzle member.

Another advantage of the present invention is the increased atomization of the fuel.

Another advantage of the present invention is the integrated premixing chamber allows further miniaturization of the nozzle assembly.

Another advantage of the present invention is that batch fabrication and batch assembly of the nozzle components reduces the cost.

Another advantage of the present invention is the reduction in number of components compared with other prior art nozzle assemblies.

Another advantage of the present invention is the use of silicon carbide allows the nozzle assembly to operate at higher temperatures than conventional systems.

Another advantage of the present invention is that the increase atomization of the fuel, due to the nozzle design and operation, provides for a reduction in the necessary pressure as compared to conventional systems.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
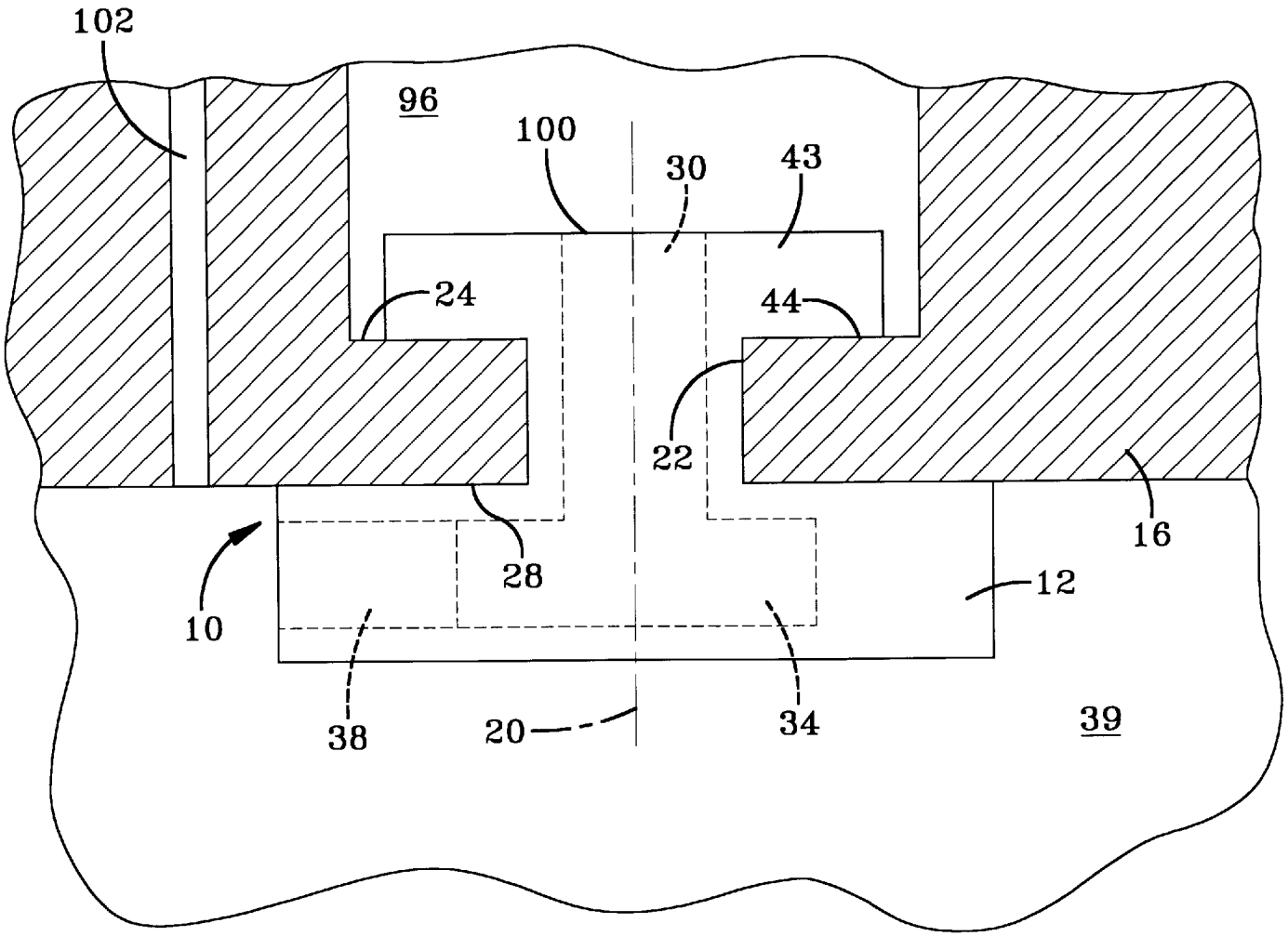
FIG. 1 is a side view, partly in section of a nozzle assembly according to the present invention.

Referring to FIG. 1, there is shown a preferred nozzle assembly 10 for injecting fuel into a combustion chamber of an internal combustion engine according to the invention.

The nozzle assembly 10 includes a rotatable nozzle body 12 carried on substrate 16 for rotation about main axis 20. Substrate 16 may be of any configuration that will accommodate rotatable nozzle body 12. In the preferred embodiment, substrate 16 includes a generally cylindrical bore 22 aligned on axis 20. Bore 22 extends completely through first and second surfaces 24, 28, respectively, of substrate 16.

As a general characterization, rotatable nozzle body 12 includes a fuel supply passage 30 in flow communication with an internal fuel distribution cavity 34. At least one curvilinear fuel delivery channel 38 is formed in the rotatable nozzle body 12 for directing fuel from the internal fuel distribution cavity 34 to the combustion chamber 39. In the preferred embodiment, curvilinear fuel delivery channel 38 is generally disposed in a plane perpendicular to axis 20.

Rotatable nozzle body 12 includes a flange 43 having a surface 44 adapted to seat on surface 24. When pressurized fuel contacts the nozzle body 12, the pressure seals the surfaces against undesirable fuel flow between surfaces 24 and 44.

Figure 2:
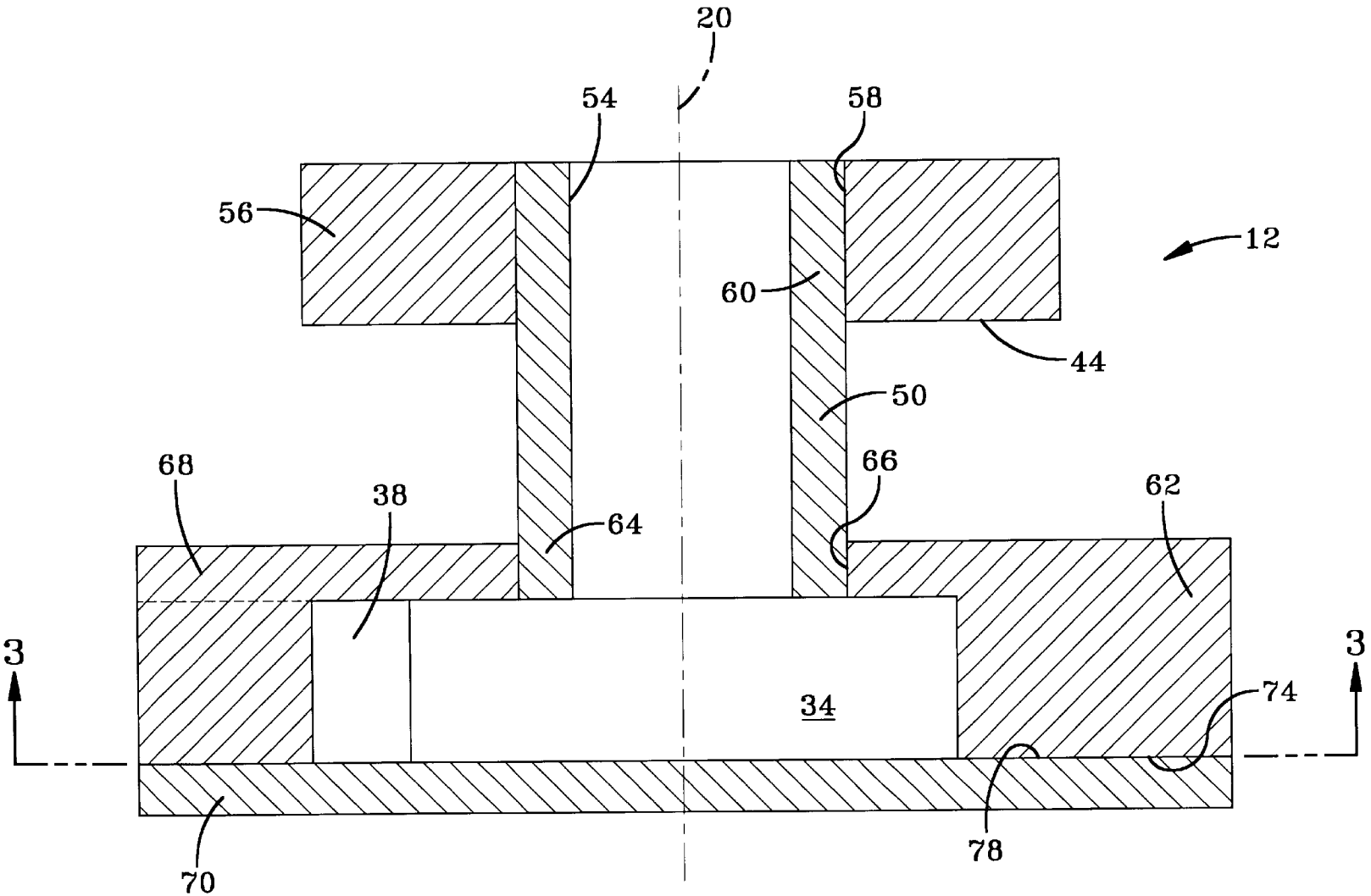
FIG. 2 is a side sectional view of a nozzle body according to the invention.

With particular reference to FIG. 2, the preferred construction of rotatable nozzle body 12 will be described. In the preferred embodiment, one or more components of the rotatable nozzle body 12 are batch fabricated using deep reactive ion etching in silicon carbide using MEMS technology. The preferred dimensions for the components of the nozzle body 12 are on the order of 50 microns to several hundred microns. Spacer member 50 is generally a hollow cylinder wherein the internal surface 54 defines the fuel supply passage 30 when the nozzle body 12 is assembled. The outer diameter of spacer 50 is adapted to be closely received within bore 22 of substrate 16. Flange 43 of the fully assembled nozzle body 12 is formed by anchor member 56 which has a central bore 58 which receives a first end 60 of spacer member 50. In the preferred embodiment, spacer member 50 is fixedly secured to anchor member 56 by bonding or other means known in the art. The preferred bonding method utilizes technology that incorporates differences in coefficients of thermal expansion (CTE) as is known in the art. It is within the scope of the present invention to provide an integral component encompassing the cylindrical spacer member 50 and the anchor member 56. Such a component would essentially be a hollow cylinder having a flanged first end.

In the preferred embodiment, the rotatable nozzle body 12 also includes base member 62 that encompasses the internal distribution cavity 34. Base member 62 is fixedly secured to the second end 64 of spacer member 50. In the preferred embodiment, base member 62 includes an axial bore 66 that is dimensioned to receive the second end 64 of spacer member 50.

Base member 62 is preferably formed of first body potion 68 and second body portion 70 which cooperate to form the internal distribution cavity 34 and the curvilinear flow channel 38. First body portion 68 is fixedly secured to second body portion 70 by bonding or other means. In the preferred embodiment, the first body portion 68 includes a planar surface 74 that abuts planar surface 78 of second body portion 70.

Figure 3:
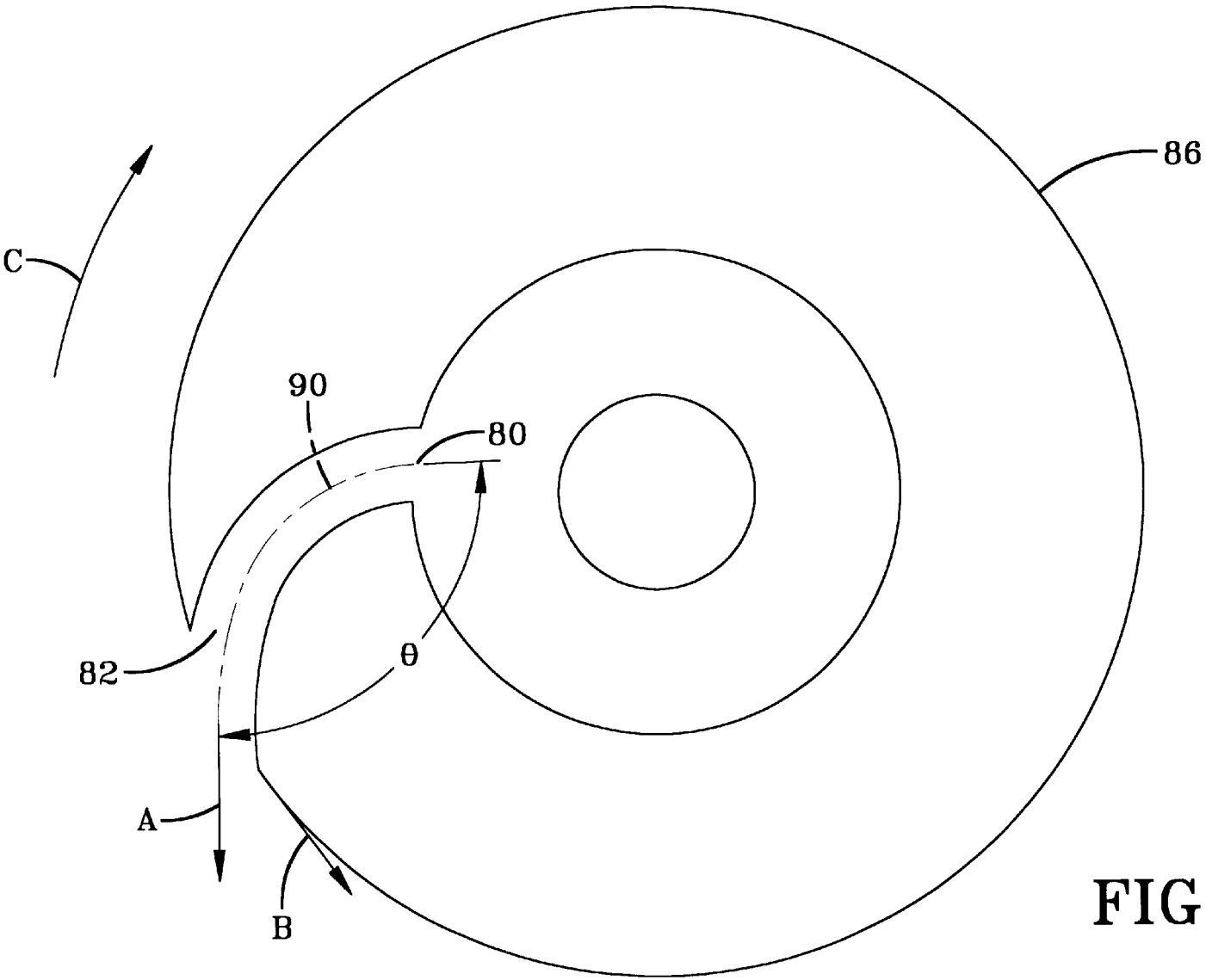
FIG. 3 is view taken along 3—3 of FIG. 2.
Figure 4B:
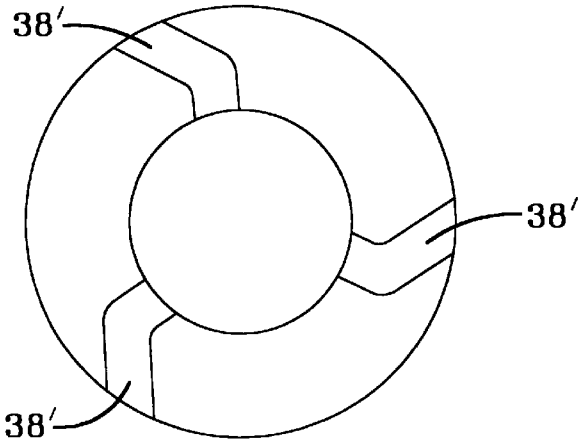
FIGS. 4A–4D are views similar to FIG. 3 of various embodiments of the present invention.
Figure 4D:
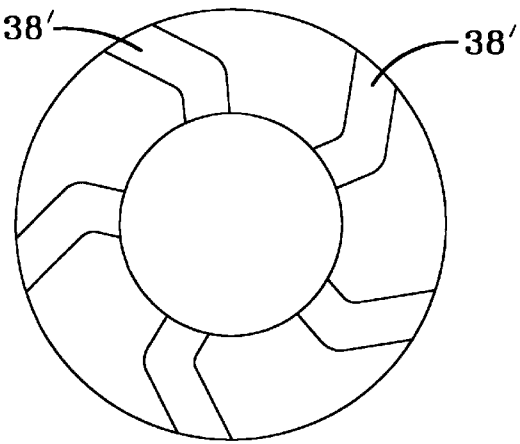
Figure 4A:
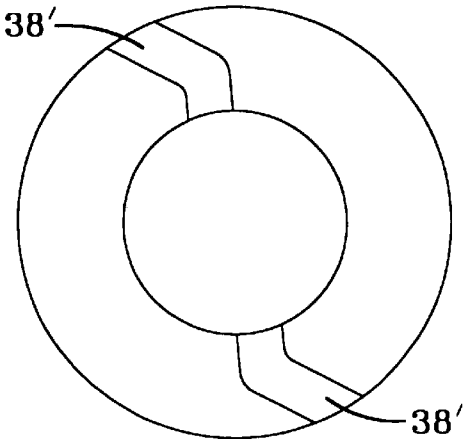
Figure 4C:
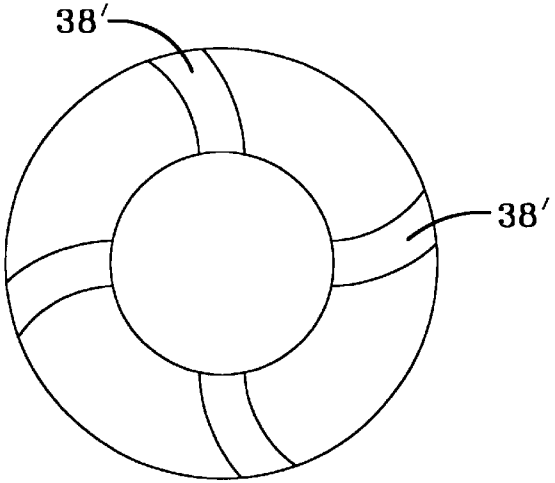

As illustrated in FIG. 3, the curvilinear fuel delivery channel 38 has an inlet 80 that communicates with internal fuel distribution cavity 34 and an outlet 82 that extends through the exterior surface 86. The curvilinear fuel delivery channel 38 includes a curvilinear longitudinal axis 90 extending through an angle of curvature, Θ. As fuel passes through the curvilinear fuel delivery channel 38 and into the combustion chamber 39, as indicated by arrow A, the curvilinear fuel delivery channel 38 imparts a tangential component to the fuel flow. The tangential component, represented by arrow B, imparts a reaction force onto the exterior surface 86 causing the fully assembled nozzle body 12 to rotate about axis 20, as indicated by arrow C. As the fuel exits the nozzle body 12, the rotation of the nozzle body 12 carries the fuel about axis 20 to define a volume of revolution within the combustion chamber 29. The angle of curvature, Θ, may have any value greater than 0° that will produce the desired rotational effect.

FIGS. 4A–4D, show various embodiments of the invention wherein the nozzle body 12 may include more than one curvilinear fuel delivery channel, 38'. Further, it is within the scope of the present invention to provide a variety of shapes for curvilinear fuel delivery channels, 38', so long as the action of the exiting fuel drives the rotation of nozzle body 12.

With reference again to FIGS. 2 and 3, in the preferred embodiment, the planar surface 74 of the first body portion 68 is etched to form what will become the internal distribution channel 34 and the curvilinear fuel delivery channel 38 in the assembled nozzle body 12. It is within the scope of the present invention to etch the planar surface 78 of second body portion 70 to provide what will become the internal distribution cavity 34 and the curvilinear fuel delivery channel 38 when the nozzle body 12 is assembled. It is further within the scope of the invention to form a partial cavity and/or a partial channel in the planar surface 74 and planar surface 78 so that a complete internal distribution cavity 34 and complete curvilinear fuel delivery channel 38 are formed when the nozzle body 12 is assembled.

The etching process allows for very small nozzle bodies to be formed with precise constructions, as compared to macro prior art nozzles having machined parts. Further, the process allows for batch fabrication so that many components may be simultaneously formed. This process provides great advantages over machined parts used in nozzles in the prior art. The micro dimensions of the nozzle body 12 in conjunction with the rotation thereof provide enhanced atomization of the fuel.

With reference again to FIG. 1, in the preferred embodiment, there is carried on substrate 16, means defining an integrated fuel premix chamber 96. The premix chamber 96 is in flow communication with air and fuel supply sources (not shown). In the preferred embodiment, the premix chamber 96 has a cylindrical wall 98 intersecting the first surface 24 of the substrate 16. The entrance 100 of the fuel supply passage 30 is positioned within the premix chamber 96. In the embodiment shown in FIG. 1, substrate 16 integrates the premix chamber 96. It is within the scope of the present invention to provide a premix chamber defined by a separate cylindrical body (not shown) affixed to first surface 24 of the substrate.

In a preferred embodiment of the invention, there is provided one or more passages 102 to supply pressurized air into the combustion chamber 39 above the volume of revolution of fuel dispersed into the combustion chamber 39 to further disperse the fuel exiting the nozzle body 12. In the preferred embodiment, the air passages 102 are disposed generally parallel to main axis 20. Each air passage 102 is positioned at a distance from axis 20 equal or greater than the distance between main axis 20 and the outlet 82 of the fuel delivery channel 38.

The steps of assembling the nozzle assembly 10 include providing the substrate 16 having first and second surfaces 24, 28, respectively, and bore 22 extending therebetween; providing the hollow cylindrical spacer member 50 having an internal surface 54; providing the anchor member 56 having a surface 44 adapted to seat on first surface 24; providing the base member 62 defining the internal distribution cavity 34 and at least one curvilinear fuel delivery channel 38 in flow communication with the internal distribution cavity 34 and extending through an exterior surface 86; inserting spacer member 50 through the bore 22; affixing anchor member 56 to the first end 60 of the spacer member 50; seating surface 44 on the first surface 24 of the substrate 16; and, affixing the base member 62 to the second end 64 of the spacer member 50, wherein said internal surface 54 provides a fuel supply passage 30 in flow communication with the internal distribution cavity 34. Either the anchor member 56 or the base member 62, but not both, may be affixed to the spacer member 50 prior to inserting the spacer member 50 through bore 22.

In another preferred method of assembly, the first body portion 68 of the base member 62 is affixed to the spacer member 50 prior to affixing the second body portion 70 to the first body portion 68.

The step of providing the base member 62 with the internal fuel distribution cavity 34 and the fuel delivery channel 38 is a crucial part of the present invention. In the embodiment shown in FIG. 3, the internal fuel distribution cavity is preferably from 50 microns to 500 microns, inclusive, in diameter and occupies about ¼ of the surface area defined by the exterior surface 86 in a plane containing planar surface 74.

The invention has been described with reference to preferred embodiment. Obviously, modifications and alterations will occur to others upon a reading and understanding of this specification. It is intended to include all such modifications and alternations in so far as they come within the scope of the appended claims or the equivalence thereof.

Having thus described the invention, it is now claimed:

1. A nozzle assembly adapted to deliver fuel from an associated supply source to an associated combustion chamber comprising:

a rotatable nozzle body having a first flange surface and including a supply passage aligned on a main axis thereof, said rotatable nozzle body being adapted for rotation about said main axis and defining an internal fuel distribution cavity in flow communication with said supply passage, said rotatable member further defining at least one curvilinear fuel delivery channel in flow communication with said internal fuel distribution cavity and being disposed in a plane generally perpendicular to said main axis, said curvilinear fuel delivery channel having an outlet opening through an exterior surface of said nozzle body;

substrate means having a bore aligned on said main axis for rotatably supporting said nozzle body therethrough, said substrate means including a first seating surface for seating said flange surface; and premixing means carried on said substrate for premixing fuel from said associated supply source, said premixing means being operative to deliver said fuel to said supply passage.

2. The nozzle assembly of claim 1 further comprising:

means carried on said substrate for providing pressurized air to said associated combustion chamber, said air providing means being operative to direct a stream of air past said outlet.

3. The nozzle assembly of claim 1 wherein said nozzle body comprises:

a spacer member having a hollow cylindrical body wherein said supply passage is defined by an internal surface thereof, said spacer member having first and second ends;

an anchor member fixedly secured to said first end of said spacer member, said anchor member encompassing said first flange surface; and, a base member fixedly secured to said second end of said spacer member, said base member encompassing said internal fuel distribution cavity and said curvilinear fuel delivery channel.

4. The nozzle assembly of claim 3 wherein said base member comprises:

a first body portion affixed to said spacer member; and, a second body portion affixed to said first body portion;

wherein said first body portion and said second body portion cooperate to form said internal fuel distribution cavity and said curvilinear fuel delivery channel.

5. The nozzle assembly of claim 4 wherein:

said first body portion comprises a planar surface having an open cavity formed therein and an open curvilinear channel communicating with said cavity and extending through an exterior surface of said first body portion; and, said second body portion having a planar surface abutting said planar surface of said first body portion to cap said open cavity and said open curvilinear channel.

6. The nozzle assembly of claim 4 wherein:

said first body portion comprises a planar surface; and, said second body portion comprises a planar surface having an open cavity formed therein and an open curvilinear channel communicating with said cavity, said planar surface of said second body portion abutting said planar surface of said first body portion.

* * * * *